US005366117A

United States Patent [19]

Mesenbring et al.

[11] Patent Number: 5,366,117

[45] Date of Patent: Nov. 22, 1994

[54] CONDIMENT DISPENSER

[75] Inventors: John M. Mesenbring, Westlake Village; Lawrence J. Patriquin, Phillips Ranch; Rory F. Ramirez, Yuba City; Dell W. Smith, Burbank, all of Calif.

[73] Assignee: Bar Master International, Los Angeles, Calif.

[21] Appl. No.: 239,846

[22] Filed: May 9, 1994

Related U.S. Application Data

[63] Continuation of Ser. No. 864,406, Apr. 6, 1992, abandoned, which is a continuation-in-part of Ser. No. 689,630, Apr. 23, 1991, abandoned.

[51] Int. Cl.[5] ..... B67D 5/46

[52] U.S. Cl. ..... 222/132; 222/95; 222/135; 222/148; 222/334; 222/642

[58] Field of Search ..... 417/383, 395, 396, 397, 417/404; 222/94, 95, 132, 135, 144.5, 148, 249, 334, 642

[56] References Cited

U.S. PATENT DOCUMENTS

| | | | |
|---|---|---|---|
| 3,863,810 | 2/1975 | Hanson | 222/129.1 |
| 4,162,028 | 7/1979 | Reichenberger | 222/144.5 X |
| 4,484,697 | 11/1984 | Fry, Jr. | 222/95 |
| 4,619,378 | 10/1986 | de Man | 222/144.5 |
| 4,753,372 | 6/1988 | Pocock et al. | 222/94 X |
| 4,887,740 | 12/1989 | Smith | 222/144.5 X |
| 4,979,644 | 12/1990 | Meyer et al. | 222/94 |
| 5,056,686 | 10/1991 | Jarrett | 222/144.5 X |
| 5,158,210 | 10/1992 | Du | 222/144.5 X |
| 5,205,440 | 4/1993 | Matsushita | 222/95 X |

FOREIGN PATENT DOCUMENTS

| | | | |
|---|---|---|---|
| 0276994 | 8/1988 | European Pat. Off. | 222/105 |
| 1272467 | 4/1972 | United Kingdom | 417/396 |

*Primary Examiner*—Andres Kashnikow
*Assistant Examiner*—Kenneth Bomberg
*Attorney, Agent, or Firm*—Harris, Wallen, MacDermott & Tinsley

[57] ABSTRACT

A system for selectively dispensing condiments for items of food, including a plurality of condiment containers, a dispenser head having a plurality of input passages, an outlet nozzle, and valves for controlling fluid flow from each of the input passages to the outlet nozzle, a plurality of fluid flow lines, with a line connecting each condiment container to a corresponding dispenser head input passage, and a fluid pump in each of the fluid flow lines whereby an operator can dispense selected condiments from the nozzle onto a food item. Arrangements for daily and bi-weekly sanitizing of the system.

6 Claims, 9 Drawing Sheets

CONDIMENT DISPENSER

This application is a continuation of application 07/864,406 filed Apr. 6, 1992, now abandoned, which continuation-in-part of application 07/689,630, filed Apr. 23, 1991, now abandoned.

BACKGROUND OF THE INVENTION

This invention relates to a system for selectively dispensing condiments such as ketchup, mustard, mayonnaise, barbecue sauce, and the like for application to items of food, typically sandwiches. The invention is particularly directed to dispensing systems suitable for use at modern day fast food stores where the staff prepare sandwiches for delivery to customers, and at sporting events and the like wherein the individual customers apply condiments of their liking after receiving the food item.

Dispensing systems for beverages have been in use for some time, including systems for mixing syrups and carbonated water or other mixes, and for mixing alcoholic drinks with selected mixers. U.S. Pat. Nos. to Hanson, 3,863,810; Reichenberger, 4,162,028; de Man, 4,619,378; and Smith, 4,887,740 are representative of such prior devices.

The condiment dispenser of the present invention is for the application of prepared sauces and spreads such as mustard, mayonnaise, ketchup, barbecue sauce and other dressings to prepared foods such as hamburgers, salads and sandwiches that enhance the food's palatability. The specific markets targeted, but not limited to, are commercial high-volume food preparation areas such as fast food outlets, convenience stores, restaurants and lunch counters where gallons of condiments may be dispensed in individual portions during the course of the average work day.

Traditional methods of applying condiments include several versions of the spatula and bucket, the hand pump style dispenser, squeeze bottles and gravity dispensed bulk containers. Each version of current applicators has limitations when considering fast, efficient application of condiments.

The spatula and bucket offer inconsistent portions, splashing and dripping of condiment between the bucket and food receiving the condiment, relatively large open mouths on the buckets which are natural pathways for contamination and oxidation of condiments, limited capacity, and occupation of space in the food preparation area for their use.

The hand pump style dispenser offers consistent portions but requires the food handler to position each individual food item under the dispenser spout, resulting in limited capacity and occupation of space in the food preparation area.

Squeeze bottles fail where large amounts of condiment are dispensed in that to be of a size practical to be hand-held, they require frequent refilling or numerous extra bottles available for use.

Many of the devices previously mentioned are refilled with product that comes in quart and gallon size containers as a matter of practical handling and convenience. These containers have also proved to be of a size that occasionally are subject to pilfering for use outside of the intended establishment.

Gravity dispensed bulk containers require the individual handling of food items plus the loss of valuable workspace in the food preparation area.

Common to each of these methods is the requirement for individual applicators for each condiment during the routine of food preparation.

SUMMARY OF THE INVENTION

It is an object of the present invention to provide a new and improved condiment dispensing system which novelly overcomes the disadvantages of the prior art as follows:

a. Designing and manufacturing a condiment dispensing system that is readily approved by the NSF (National Sanitation Foundation) for the variety of condiments allowing for the use of the NSF approval mark.

b. Having the innate ability to be easily and quickly cleaned and sanitized both daily and bi-weekly.

c. Having the ability to use the full contents of the condiment bag container with insignificant throwaway.

d. Making use of purely mechanical methods and FDA approved materials, a major consideration for target market acceptance, for the basic pressure, pump, head dispensing system or any other part that comes in contact with the food.

e. Using a modular approach to sub-assemblies and assemblies within subassemblies. For four primary reasons:

1. Ease of Growth to a large matrix of condiments and dispenser guns (10×10).
2. Allows easy cleanability for sanitation purposes.
3. Allows easy maintainability.
4. Allows easy serviceability.
4. Allows easy mounting/positioning into available store space.

f. Making use of a negative pressure (suction) on a hanging bag condiment container (similar to Bag N Box) and specially designed "OPEN/CLOSED-CONNECT/DISCONNECT VALVE" fittings on modular condiment bag container as well as the manifold and modular pump to provide a completely closed (non-contaminated) system from condiment bag to dispenser head. Note: Contamination with oxygen or other undesirable molecules would allow for oxidation and bacteria growth within the condiment dispenser.

g. Having the propellant gas for the pump isolated and not mixed with the pumped condiment fluid. This allows for a pure and "UN-GASSED" tasting condiment that are not contaminated with the propellant gas and the impurities in the gas propellant.

h. Having a pump which operates over a range of many different condiment fluid viscosities and many different condiments.

i. Having the ability to adjust the speed of the pump via a regulator for the thickest (most viscous) condiment to be used on the particular pump line allowing constant volumetric output without cavitation in the pump chamber.

j. Making use of a propellant gas for the pump that is widely available in the food preparation industry, such as Carbon Di-Oxide (used for carbonation) hereafter referred to as CO2, or compressed air.

k. Having a dual chamber pump that allows for volumetric metering (constant volume output per discharge) of the pumped condiment fluid within the range of condiment fluids used.

l. Having the intrinsic ability to portion control the metering pump using an externally attached circuit and solenoid gas valves for attaching to the gas input or output side of the pump regulating its flow (TTL level digital control circuitry for timing and relay/12 VDC solenoid control on the gas propellant source) based on the metering capability of the pump.

m. It is a particular object of the invention to provide a condiment dispensing system which can be operated with one hand and provides for selective dispensing of a plurality of condiments as desired by the operator.

n. A further object of the invention is to provide such a system which requires very little work space and storage area.

o. Another object of the invention is to provide the operator with native ease of use within the environment it is designed. This can be defined in terms of cleanability and dispensing operation.

p. A further object of the invention is to provide a system that allows for a minimum downtime for replenishing condiment supplies.

The presently preferred embodiment of the invention includes a plurality of condiment containers, pumps/-regulators and splitter manifolds, a dispenser head having a plurality of input passages, an outlet nozzle, and valves for controlling fluid flow from each of the input passages to each outlet nozzle, and a plurality of fluid flow lines, making use of a self sealing (contaminate free) quick connect/disconnect sanitary valves between each line at each module. A propellant gas driving a wide viscosity range metering dual chamber fluid pump which keeps the propellant gas separated and isolated from the condiment food, for each condiment fluid flow line, whereby an operator can sequentially dispense selected condiments from the nozzle onto a food item.

DESCRIPTION OF THE PREFERRED EMBODIMENT

The condiment dispenser includes three major subassemblies:

I. The Bag Hanger

II. The Pump, Regulator and Splitter Manifold Module (here after referred to as the PRM Module)

III. The Dispenser Head Module

Each one of these modules will be described separately as to the details of their construction and operation both individually and as a system.

I. BAG HANGER MODULE

Figure 3:
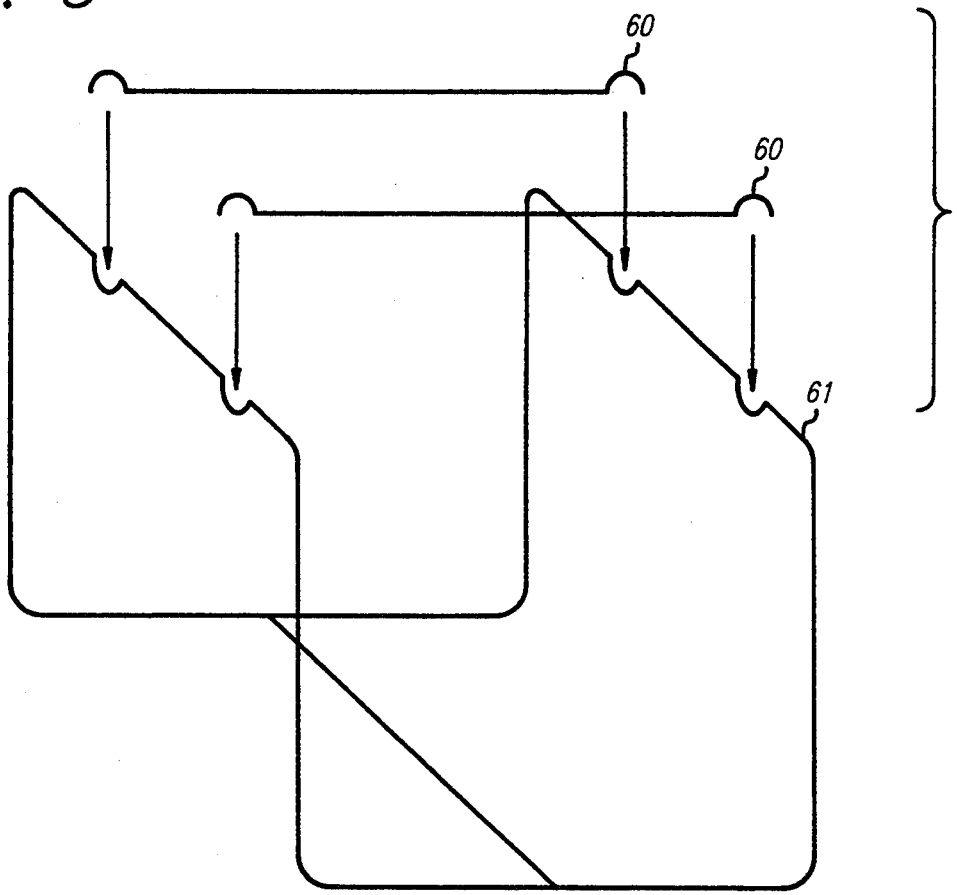
FIG. 3: Bag Hanger Module for two condiment bags.
Figure 4:
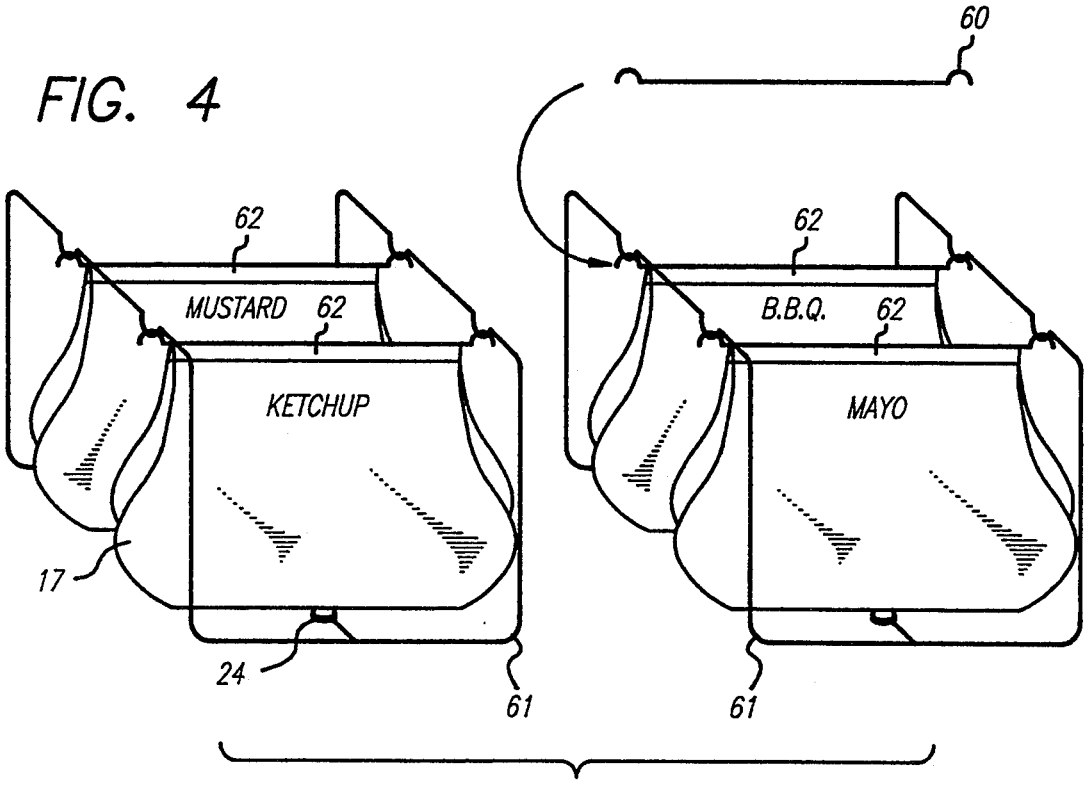
FIG. 4: Two Bag Hanger Modules, each with two condiment bags attached.

I. Bag Hanger Module - FIG. 4 and 3 show the bag hanger module with and without condiment bags attached respectively. The bag hanger rack 61 holds two condiment bags 17 on hangers 60. The hangers are attached with bag clip 62.

The ease of use (serviceability/maintainability) in changing condiment bags is as follows (see FIG. 4): To attach the condiment bag 17 to the hanger 60 wrap condiment bag 17 over bag hanger 60 and clip bag clip 62 to the bag 17 and the hanger 60 (similar to hanging clothes on a clothes line). Pick the bag up by both ends of the hanger 60 and position on the hanger rack 61.

Another way of attaching the condiment bag 17 to hanger 60 is to heat seal a seem on the bag thus that a channel is created allowing hanger 60 to be comfortably positioned through. Once the hanger 60 is passed through the seem on bag 17 the bag may be hung from the rack as above.

The attachment of pump feed line 23 to bag 17 is done using industry known BIB connectors 24. This type of connector is an NSF approved easy to use self sealing open/close-connect/disconnect sanitary valve.

Both the suction provided by the dual chamber metering pump and the gravity feed aspect of the Bag Hanger Module allow 99.6% evacuation of the 5 gallon bag condiment container 17. A quick connect/disconnect sanitary valve 24 is carried at the center bottom of the condiment bag 17. The positioning of this valve assists in obtaining 99.6 % evacuation of the condiment bag.

If perchance mechanical head is needed to assist in the priming of the pump the height of the Bag Hanger Module may be raised to do so. Currently in the present embodiment with condiment fluids viscosities as thick as 300,000 cps, the height of the Bag Hanger Module at 16 inches is sufficient.

Figure 2:
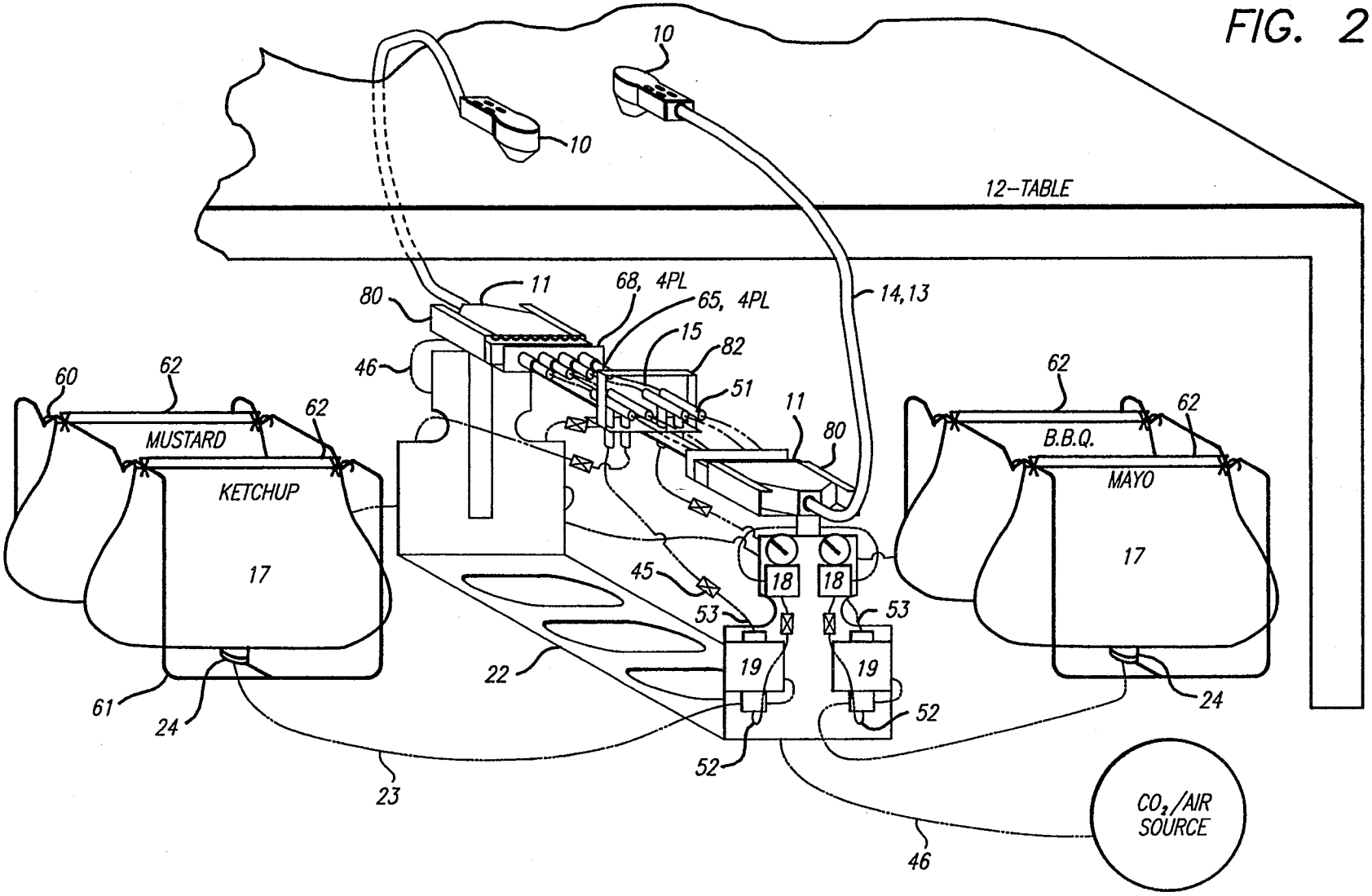
FIG. 2: A perspective view of a condiment dispensing system incorporating the presently preferred embodiment of the invention. Shown are three main subassemblies as follows: the Pump Regulator & Manifold Module, Dispenser Head Module and Bag Hanger Module.

The present invention allows remote positioning of all modules. The positioning of the Bag Hanger Module 60 is quite simple. Feed line 23 may be up to 14 inches long requiring positioning the condiment bag racks 61 in close proximity to the PRM Module. In FIG. 2, the PRM Module is positioned under a work table with two Bag Hanger Modules sitting on both sides of the PRM Module. Two Dispenser Head Modules are attached to the PRM Modules at docking locations 80.

Although not shown in the present embodiment, the condiment bags also may be held in Bag-N-Box arrangement or positioned in plastic/stainless steel holder frames.

II. Pump, Regulator & Manifold (PRM) Module

II. The PRM Module is built around a ruggedized functional "Tool Box" appearing light weight aluminum chassis 22, see FIG. 2. The pumps 19, regulators 18, passive splitter manifolds 51 and dispenser head manifold docks 80, as well as the associated tubing and sanitary connectors 45, 23, 15, all connect to this PRM "toolbox" chassis 22.

Figure 1A:
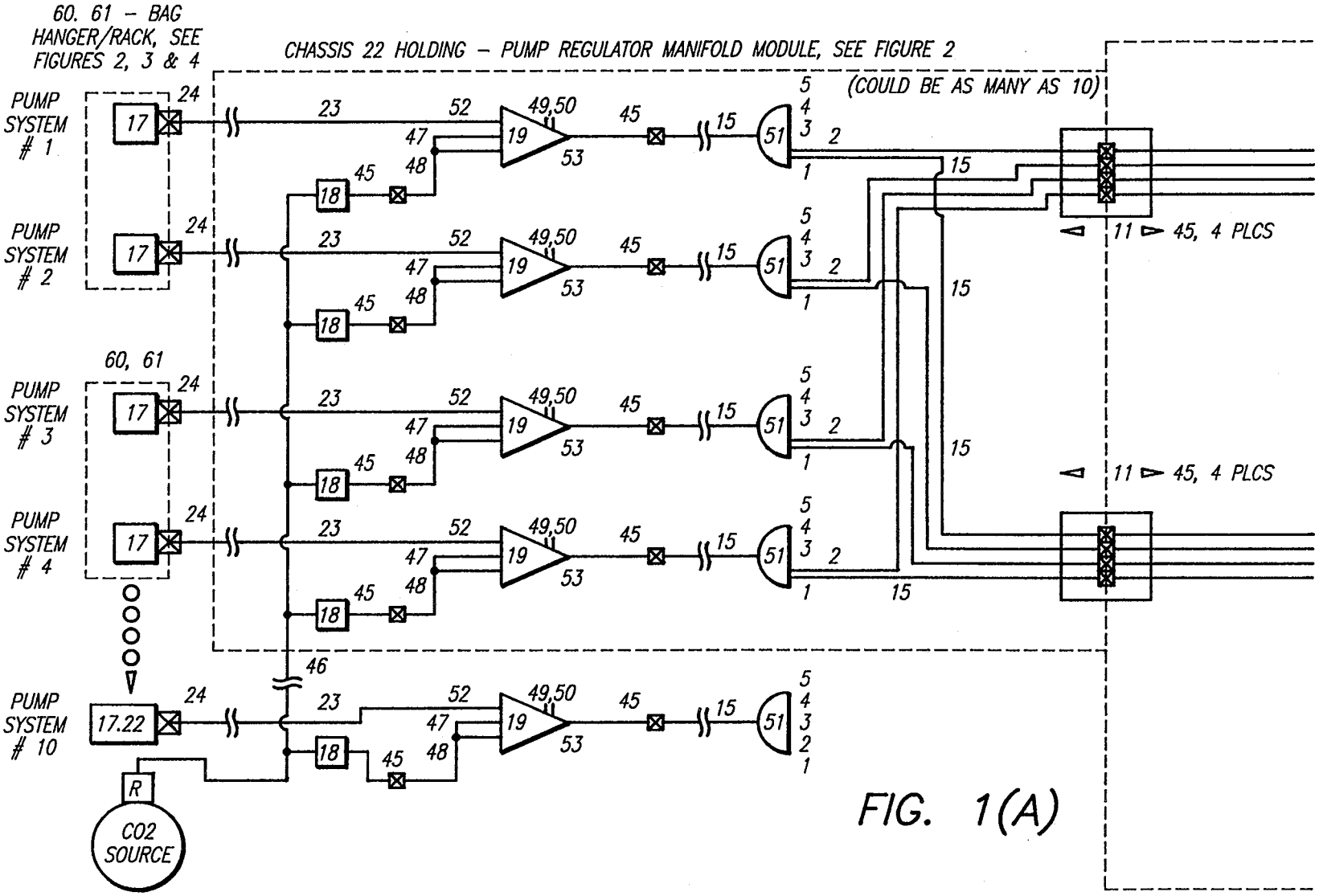
FIG. 1: A diagram showing the logical operation of the pumping invention. Dashed lines are drawn around the three main modular subassemblies: The Bag Hanger Module (FIGS. 2, 3 & 4), the Pump, Regulator and Manifold Module installed in chassis (FIG. 2 & 7), and the Dispenser Head Module (FIGS. 2, 6, 8 & 9). Please note that item 10 on FIG. 1 is a logical (AND-OR) equivalent of the valving in the condiment gun.
Figure 1B:
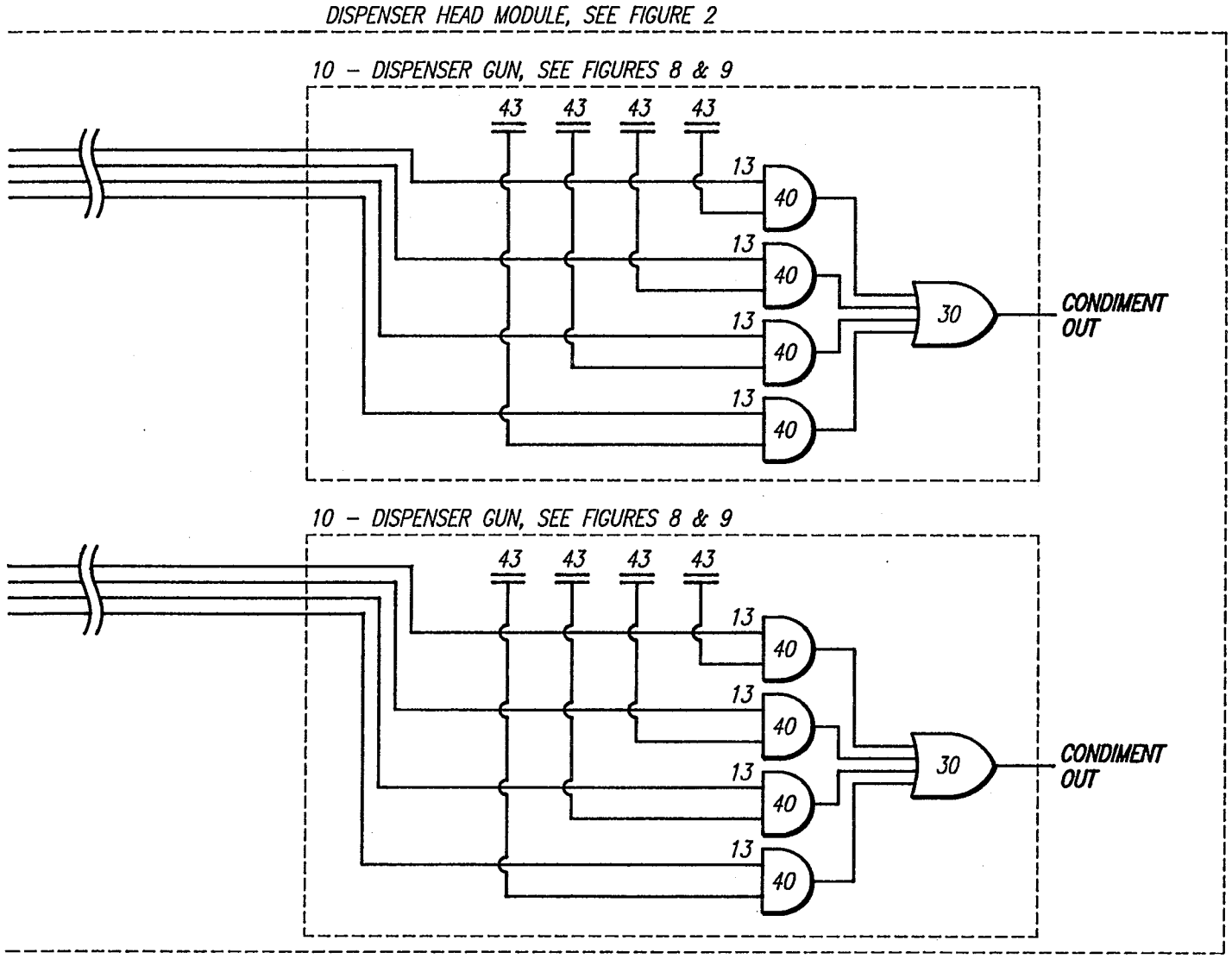
Figure 5:
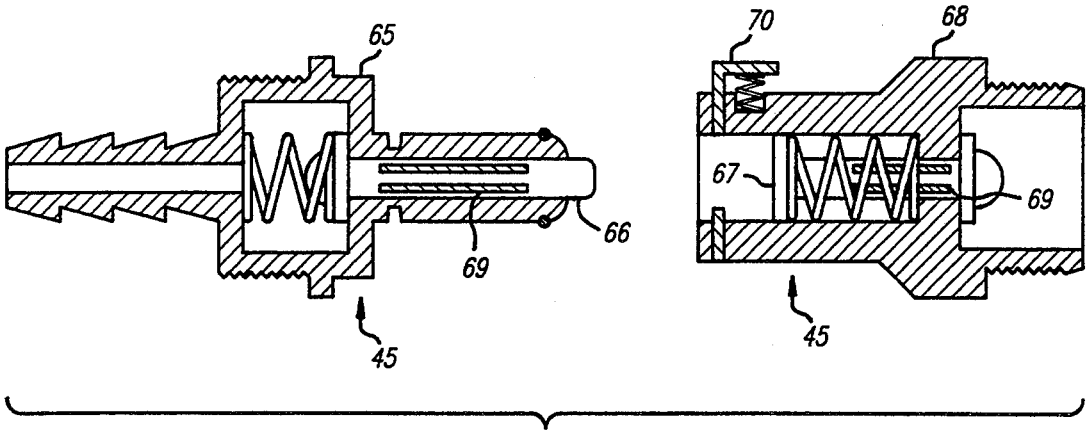
FIG. 5: Sanitary Valve.

The logical connectivity of the system can best be seen in FIG. 1 and FIG. 2. Larger ½" sanitary tubing 23 with BIB connector valve 24 lead from the bag container 17 to the inlet side 52 (see FIG. 10) of the pump 19. Inlet propellant gas on lines 47 and 48 drive each side of the dual chamber gas driven pump and each chamber of the pump operates 180 degrees out of phase with the other chamber/side of the pump. Exhaust gas is released in a similar fashion on the pump exhaust lines 49 and 50. From pump 19 condiment fluid output line 53 runs through a open/close-connect/disconnect sanitary valve 45 (see FIG. 5) to a passive splitter manifold 51.

Please note that FIG. 1 shows a passive splitter manifold 51 with one input on line 15 to five output lines with a provision for 10 output lines. The limit on the number of output lines is purely a function of the limit of the delivery system and the duty cycle of the operators through dispenser heads 10. With a provision for a 1 input and 10 output splitter manifold 51-ten dispenser head modules may be used. FIG. 2 shows a passive splitter manifold 51 as a T-connector (one input and two outputs).

As the number of pumping systems each including items 11,15,18,19 23,45,47,48,49,50,51,52,53 increase to ten, a ten button dispenser gun can be used. The range of plurality of condiments to be dispensed at the dispenser guns 10 is a function of the number of pumping systems and the number of ported valves in the dispenser gun heads 10. On the other hand, the limit of the number of dispenser head guns is purely a function of the delivery system ported through splitter manifold 51 and the duty cycle of the individual dispenser guns 10.

From splitter manifold 51 the condiment fluid is pumped through ½" inlet line sanitary tubing 15 in the manifold to a quick disconnect manifold 11. The quick disconnect manifold 11 is docked in PRM Module "Tool Box" chassis 22 at manifold dock 80 (shown in FIG. 2 and logically shown in FIG. 1). The Quick Disconnect Manifold (also referred to as the QDM) 11 makes use of four Sanitary Valve Connectors 45 shown in FIG. 5. Barb side 65 of Sanitary Valve Connector 45 are attached to manifold dock 80. Side 68 of Sanitary Valve connector 45 are attached to Quick Disconnect Manifold 11.

The Sanitary Valve Connectors 45 are closed (see FIG. 5) when disconnected and open when connected. When connected, spring loaded shaft 67 on side 68 and spring loaded shaft 66 on barb side 65 are displaced permitting fluid to flow through the inside of the shafts to the porting on the outside of the shafts 69 for fluid flow through the shaft. When disconnected (closed) the porting holes 69 are not open and no fluid can flow through.

When connected, spring loaded clip 70 latches the barb side 65 of the Sanitary Valve 45 and locks it into place with side 68. To disconnect the Sanitary valve press down on latch 70 and pull apart.

As above, Sanitary Valve Connectors 45 are shown throughout the current embodiment. The Dispenser head manifold 11 at docking locations 80 on the "Tool Box" chassis 22 uses four pieces of barb side 65 in each manifold dock 80 and four pieces of side 68 are used in mating Quick Disconnect Manifold 11. On pump 19 two pieces of Sanitary Valve are used on the inlet propellant gas side 47 and 48 and outlet 53 side.

One purpose of these valves is to provide a lock tight fluid connect-disconnect feature for condiment fluid, sanitizing washing fluids, and propellant gas for the pump 19, provide modularity at connect-disconnect locations as well as to provide seviceability/maintainability for critical components such as pump 19. If pump 19 was to fail, detach the condiment bag connector valve 24, disconnect Santitary valve 45 between regulator 18 and pump propellant gas inlets 47 and 48, disconnect condiment fluid output line 15 between 53 and manifold 51 at Sanitary Valve 45 and loosen two allen head screws holding pump 19 on "Tool Box" chassis 22. Then the pump is lifted vertically ½" and may be removed. This takes approximately 30 seconds or less for a service technician.

Regulators 18 regulate the pressure from the propellant gas supply line 46 down to a preset pressure that allows a constant flow rate based on the thickest (coldest) form of the particular condiment fluid being pumped out of line 15. Typically a condiment fluid becomes thicker (higher viscosity) as the operating temperatures of the condiment decreases. Thus, the preset pressure to the pump 19 from the regulator 18 is based on the ability of the pump to reliably deliver condiment at a customer specified minimum flow rate. As the temperature of the condiment fluid increases the speed at which the pump will run for the same regulator pressure will increase. The range of speed increase by the pump 19 to a given increase in temperature in the condiment for a given condiment depends on the properties of the given condiment. Both flow rate ranges based on temperature ranges should be checked and the regulator set accordingly.

As with the Bag Hanger Module, the ease of positioning of the PRM Module chassis 22, is quite simple. Feed line 23 from condiment bag container 17 hanging on Bag Hanger Module 60,61 attaches to pump 19. In the embodiment illustrated, Condiment Dispenser Gun supply lines 13 may be up to 4 feet long.

It should be noted, that the pump 19 line 15 to passive splitter manifold 51 (½" sanitary tubing) may be 100 feet long for other embodiments. With lines 15 up to 100 feet long and dispenser head lines 13 up to 4 feet long, a good range of remoteness in position/mounting relative to the target market kitchen food preparation areas is available.

Figure 10:
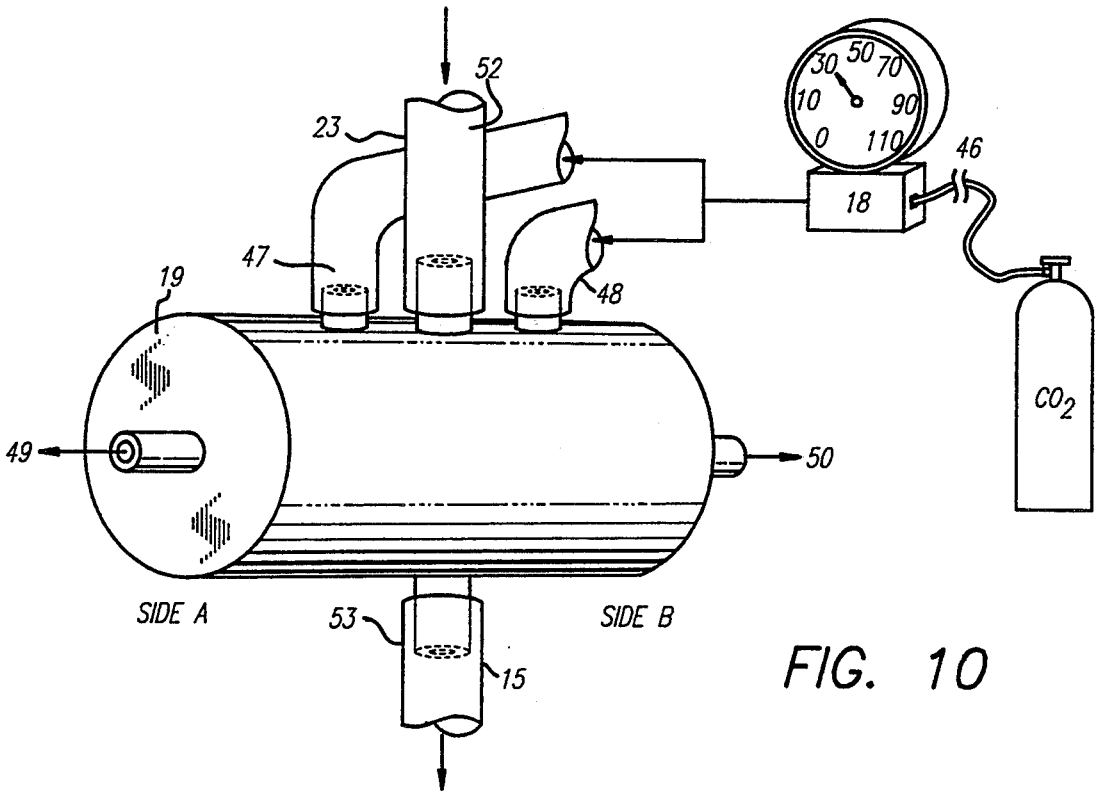
FIG. 10: Dual chamber metering pump.

The pumping arrangement as shown in FIG. 10 is of particular importance in the condiment dispensing system of the present invention. Making use of a dual chamber gas pump in the specified connectivity (FIGS. 1 and 10) makes up for some of the disadvantages of the previous condiment systems as follows:

a. Propellant gas is not mixed with food fluid. Propellant gas coming in on pump 19 (see FIG. 10) through gas inlet 47 of pump side A and exhausted to the atmosphere on pump exhaust port 49 of pump side A is not in contact with condiment food fluid. Correspondingly, propellant gas coming in on pump 19 through gas inlet 48 of pump side B and exhausted to the atmosphere on pump exhaust port 50 of pump side B is not in contact with the condiment food fluid.

Having the propellant gas for the pump isolated and not mixed with the pumped condiment fluid allows for a PURE and "UN-GASSED" tasting condiment. Equally important is that condiments are not contaminated with the propellant gas and the impurities in the gas propellant. Contamination with oxygen or other undesirable molecules allow for oxidation and bacteria growth within the condiment dispenser system. For NSF approval this would weigh against previous designs.

Additionally the marketability of such a system is greatly improved by keeping the specified condiment fluid out of contact with any contaminate (such as the propellant gas and it's impurities) that would change the taste and texture of the condiment being dispensed out of dispenser head 10.

b. CO2 gas is widely available in the food industry for carbonated beverages. Making use of a gas, such as CO2, that is extensively used in the food industry as the pump propellant gas means that store operators/owners do not have to invest time and monies into other ancillary supplies as CO2 gas is generally readily available. If perchance CO2 is not available, or the store does not wish to use CO2 to drive the pump, compressed air or other pressurized gasses may be used. However, any gas that is used must be able to be safely vented to the atmosphere.

c. The pumping method-suction on the condiment bag 17 through valve 24 into pump 19 through condiment inlet 52 and positive pressure out of the pump 19 through 53 to line 15 and forward to the dispenser head 10 provide a completely closed (non-contaminated) system from condiment bag 17 to dispenser guns 10. The importance of this can be thought of in terms of the volume of the condiment in the condiment bag 17 relative to the volume of fluid in the lines. By pulling (suction) condiment fluid out of the condiment bag 17-no pumped in impurities are introduced into human consumption food of the condiment container. When Sanitary valves 45 are disconnected and reconnected or when condiment valve 24 is disconnected and re-connected to change the condiment bag, only the amount of fluid in the condiment line need be purged to insure a pure uncontaminated condiment.

Again, condiment contamination with oxygen or other undesirable molecules allow for oxidation and bacteria growth within the condiment dispenser system.

Also the present suction pumping method on bag 17 allows efficient use of condiment supplies as 99.6% of condiment is used on a five gallon bag.

d. The present invention allows for an added portion control circuit based on single dispenser gun head 10. By replacing passive manifold 51 with a in-line coupler and operating one dispensing gun 10 with a Portion Control Module (PCM), portion control is obtained (see FIG. 11).

As above, the regulator is set for the customer specified minimum condiment flow rate based on a customer specified condiment operating temperature range and viscosity. A TTL level timing circuit is added and attaches to IN-LINE gas relay ¾ way solenoid(s) valve(s) at side A and side B of pump 19-locations 47 & 49 and 48 & 50 respectively (see FIG. 10). These solenoids valves with a timing controller/portion control module allow inlet gas to flow to one side of the dual chamber pump while exhausting gas on the other side of the pump. The intake and exhaust cycles of the pump are 180 degrees out of phase with each other, (i.e. when side A of pump 19 is discharging condiment, side B is filling-this is called a side A discharge cycle. A side B discharge cycle would be the opposite of the side A cycle). By pressing the dispenser head valve button 43 which has a switch 99 below it, and delivering the number of pulses at the required frequency for a particular type of condiment from the Portion Control Module (PCM), condiment may be portion controlled based on the number clock cycles delivered to the solenoid gas valve metered out each side of the pump.

For example: If ACME Pizza Company desires that three portion sizes 2.5, 5 and 7.5 oz of Pizza sauce be controlled for small, medium and large Pizzas, and the pump discharge per chamber A and B is 0.25 oz, then 10 displacements are required for the small pizza, 20 displacements for the medium pizza and 30 displacements for the large pizza.

The clock signal frequency (speed at which the pump chambers open and close) is set at a cycle time sufficient to accomplish a desired dispensing rate from pump 19 at the lowest operating temperature and thickest viscosity for the condiment in the operating environment.

e. The choice of the dual chamber pump type is important to provide a metered condiment output for a given condiment. Having a rigid piston and sleeve in the pump lends itself towards a metered output per discharge. Dual diaphragm type pumps on the other hand will work but the output of the pump per chamber displacement will depend on the pressure at which the pump is driven based on the stretch in the diaphragm and the viscosity of the condiment fluid. For fixed condiment fluid viscosities and delivered regulator pressures to the pump, a dual chamber diaphragm pump will suffice. However, for a system that is designed for many different condiment fluids (viscosity ranges up to 300,000 cps) and many different condiment delivery flow rates to the dispenser head 10, a dual diaphragm will not easily suffice, rather a piston sleeve type pump will be desired.

Using a rigid piston and sleeve design for the dual chamber pump with the area of the piston and stroke equating to the volume per discharge required, allows for metered output over a regulator pressure range and condiment fluid viscosity range.

The ability to adjust the speed of the pump via a regulator for the thickest (most viscous) condiment to be used on the particular pump line allows constant volumetric metered output without cavitation in the pump chamber over a range of viscosities, operating temperature ranges, and flow rates. This is a feature of the invention with a rigid piston and sleeve dual chamber pump.

III. Dispenser Head Module

III. Dispenser Head Module- the dispenser head 10, see FIG. 8, fits comfortably in the hand of the operator. The dispenser head is connected to a manifold 11 located to one side of, or under, a food preparation table 12 with tubing 13 encased in a flexible sheath 14 to allow the operator a full range of motion over the preparation table.

The valving in the dispenser head is designed to be self-cleaning with each movement of condiment through the system.

The sanitary tubing 15, is run from the discharge side of the pump 19 to the QDM 11 located in docking location 80 near the food preparation table 12, see FIG. 2. The QDM 11 serves as a point for reducing the supply lines 13 to ¼ inch diameter from ½ inch diameter at docking location 80 and encasing them in the single sanitary sheath 14 to the hand-held dispenser head 10. The QDM 11 may be similar to manifolds used in the past.

Figure 9:
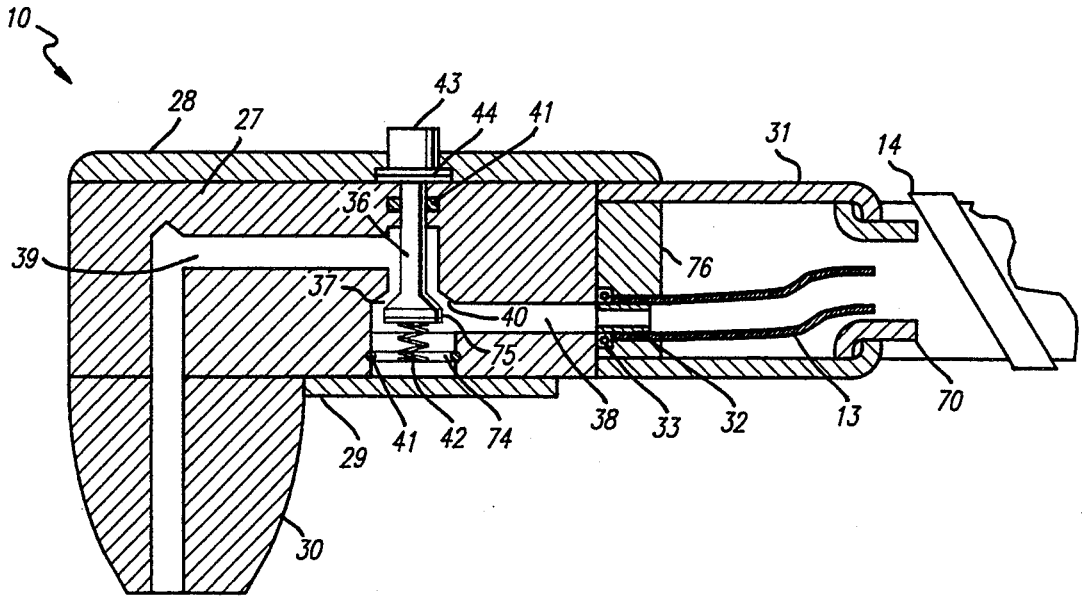
FIG. 9: A vertical sectional view of the dispenser head of FIG. 8.
Figure 8:
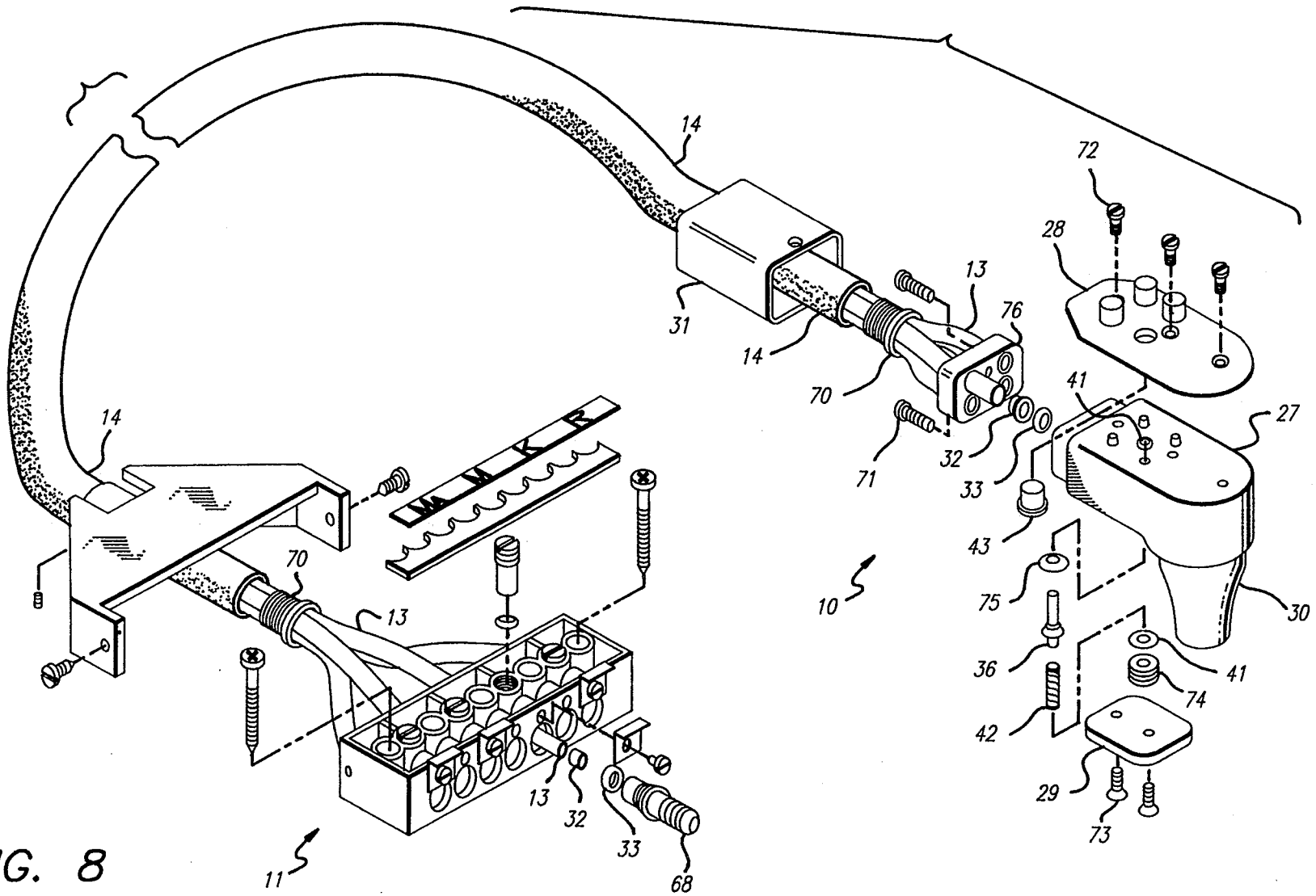
FIG. 8: A perspective view, partly exploded, of the Dispenser Head Module.

The preferred form for the dispenser head 10 is shown in FIGS. 8 and 9. The head 10 includes a body 27 with a retainer plate 28, a bottom plate 29 and an outlet nozzle 30. The sheath 14 in the form of a flexible conduit is held in place by a tail piece 31. The head components are held together by screws 71,72 and 73 as shown in FIG. 8. The tubing 13 is brought up through the sheath 14 and connected to the head body 27 with connector 32 and O-ring seal 33. A valve is provided in the head 10 for each of the lines 13. A valve plunger 36 slides in a valve passage 37 between a passage 38 in the body from the line 13 and a passage 39 to the nozzle 30, see FIG. 9. A tapered valve seat 40 and two O-ring seals 41 are positioned in the valve passage 37 keeping condiment fluid between the O-ring seals 41. A spring 42 is positioned at the lower end of valve seat seal 75 of the plunger 36 and is held in place by the bottom plate 29. A push button 43 is provided at the upper end of the plunger 36, with a rim 44 for retention of the plunger by the spring well insert 74 and retainer plate 28. The lower portion of the valve plunger 36 at valve seat seal 75 is held against the valve seat 40 by the spring 42. No flow occurs until the button is depressed pushing the plunger 36 down and the valve seat seal 75 off of the valve seat 40, allowing condiment product flow through the valve chamber and outlet passage 39 and out the discharge nozzle 30. The valve spring returns the valve to the closed position, stopping product flow when pressure is released from the push button 43. The seals 41 keep the environment and product separated.

The valving with the dispenser head is designed to be self-cleaning with each movement of condiment through the system. When button 43 is depressed, condiment flows from line 13, through passage 38, 37, 39 and then to the nozzle 30. When button 43 is released, plunger seal 75 on plunger 36 seals on passage valve seat 40. A tiny amount of condiment is around each side of valve seat seal 75 in passage 37 and 39 and valve seat 40 and is compressed by closing of the valve. When the valve is again opened this compressed condiment is pushed out of this area, through passage 39 and out nozzle 30. Thus the desired self-cleaning is obtained.

An important feature of the system is the capability of allowing an operator to selectively dispense a number of condiments from a single hand-held dispenser, with good control of the amounts being dispensed, including the ability to freely move the dispenser head to the point of dispensing and control the amount of condiment dispensed with a movement of a single thumb on button(s) 43.

Another feature of the system is that it is a closed system with no condiment fluid exposed to air or contamination.

Figure 11:
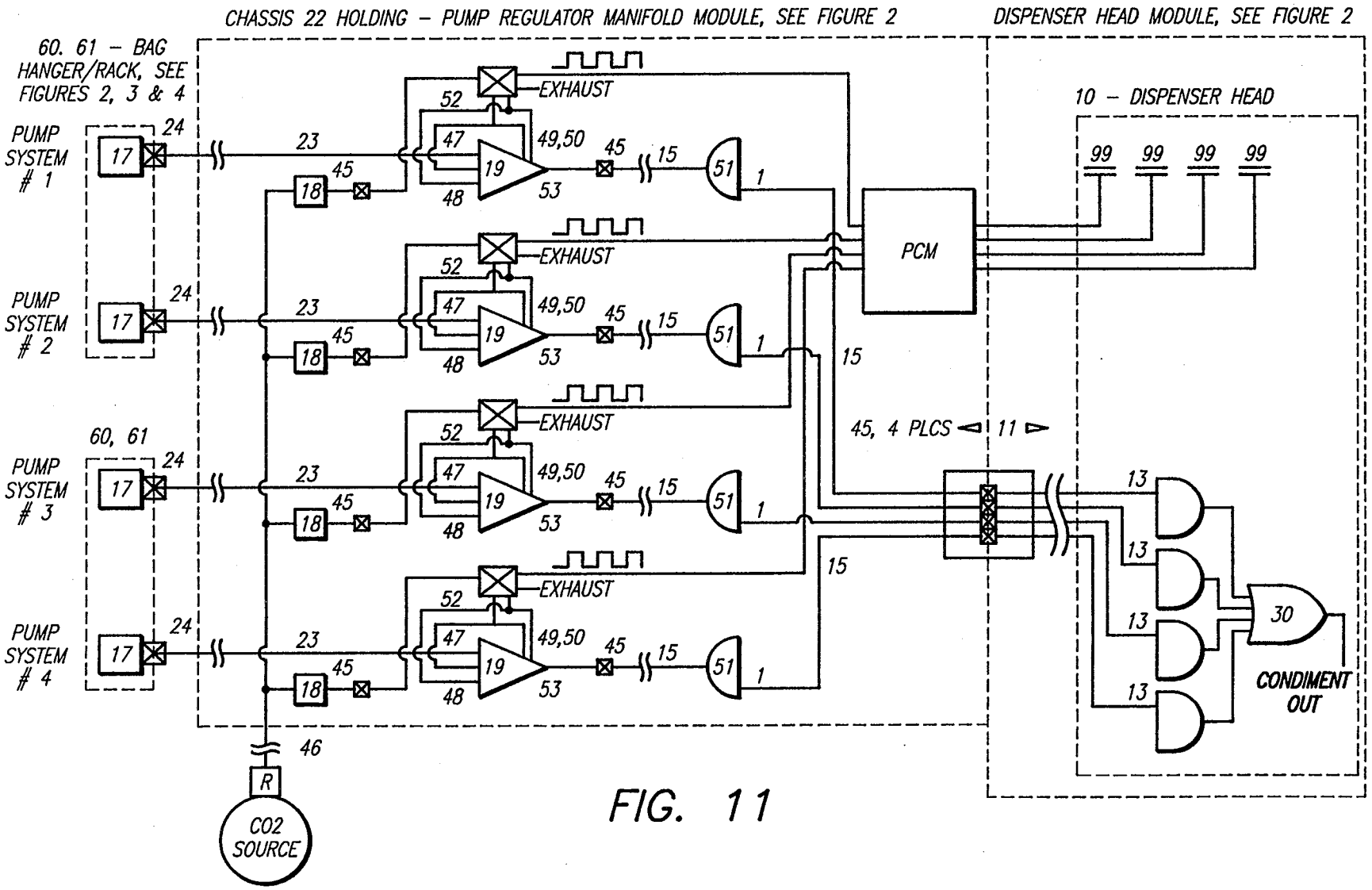
FIG. 11: A diagram showing the logical operation of the portion control aspect of the presently preferred embodiment of the invention with four pumps and one dispenser head. Dashed lines are drawn around the three main modular subassemblies: The Bag Hanger Module, the Pump, Regulator and Manifold Module installed in chassis and the Dispenser Head Module.

A further advantage of the present invention, as pertaining to the Dispenser Head, is the ability to adapt the head for portion control. As shown in FIG. 11, button valve 43 and valving 36,75,42, may be replaced with a new valve button 43 and switch 99 for starting the clock in the Portion Control Module. A solenoid valve 100 is inserted in the CO2 line from each regulator 18 to the corresponding pump 19. When a condiment product is depleted, the empty condiment bag 17 is removed and a new one put in its place. The quick action sanitary connector 24 of the bag 17 allows clean, fast switching from empty to full containers without splashing or spillage. The connectors are designed with smooth surfaces that are easily cleanable and can be used by food handlers with a minimum of care.

DAILY and WEEKLY SANITIZING

The condiment dispenser of the present invention has received NSF approval. NSF approval is based on a number of criteria including the washing, cleaning and sanitizing methods.

Figure 6:
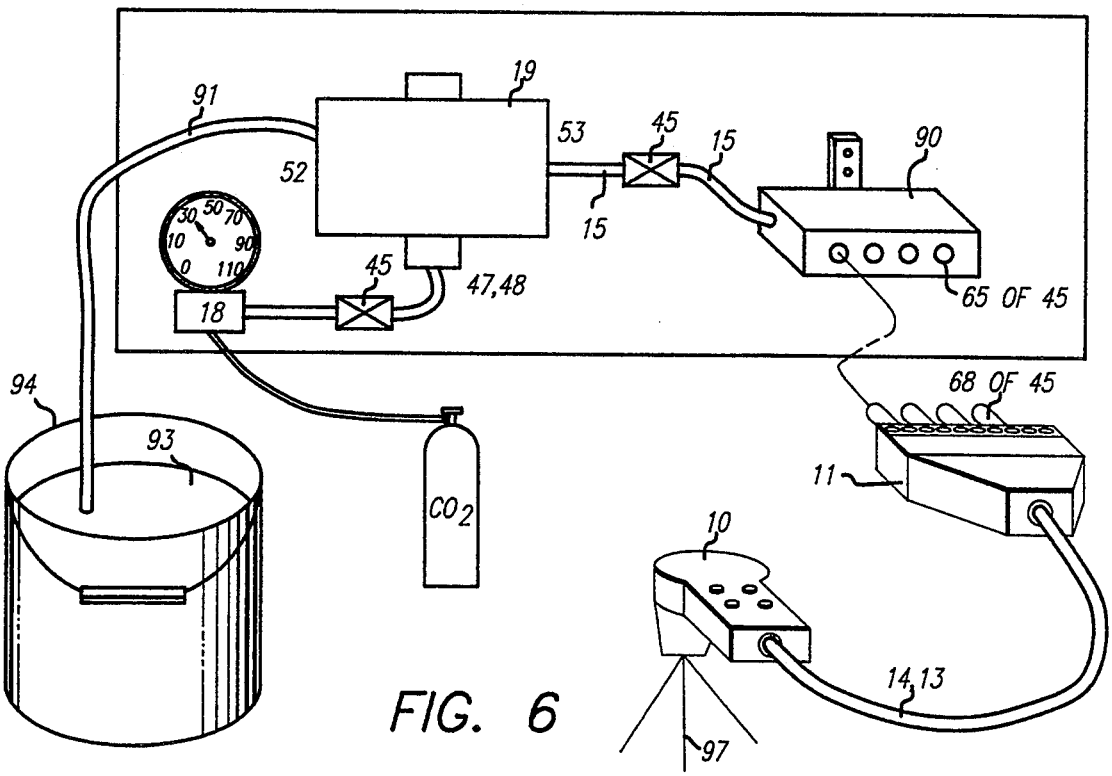
FIG. 6: Daily Sanitization Manifold & Pump Module.

Daily cleaning, see FIG. 6, of the condiment system is performed by disconnecting QDM 11 at docking location 80 on "Toolbox" chassis 22 and plugging QDM 11 into Sanitizer Docking Block 90. The daily cleaning system has pump connectivity the same as a single pump system shown in FIG. 1 except line 91 is the feed line for hot water wash fluid 93 held in five gallon bucket 94 as shown in FIG. 6. A sink or any other container may be used to hold the hot water.

Mounting of the daily cleaning system is modular. The block and pump may be stored out of the way or mounted on a wall near a sink or drain.

The Daily Cleaning Module provides other benefits in addition to cleaning. The extra pump, regulator and fittings are the same as those used on the PRM Module. If a pump 19 on the PRM was to fail, a spare pump would be on hand immediately. Thus downtime could be kept to a minimum.

After connecting QDM 11 to sanitizer docking block 80 run hot water through system for 1.5 minutes by depressing button 43 on valve 40 on all valve buttons on dispenser head 10. After operation is complete, rinse with water and replace QDM 11 to docking location 80.

Figure 7:
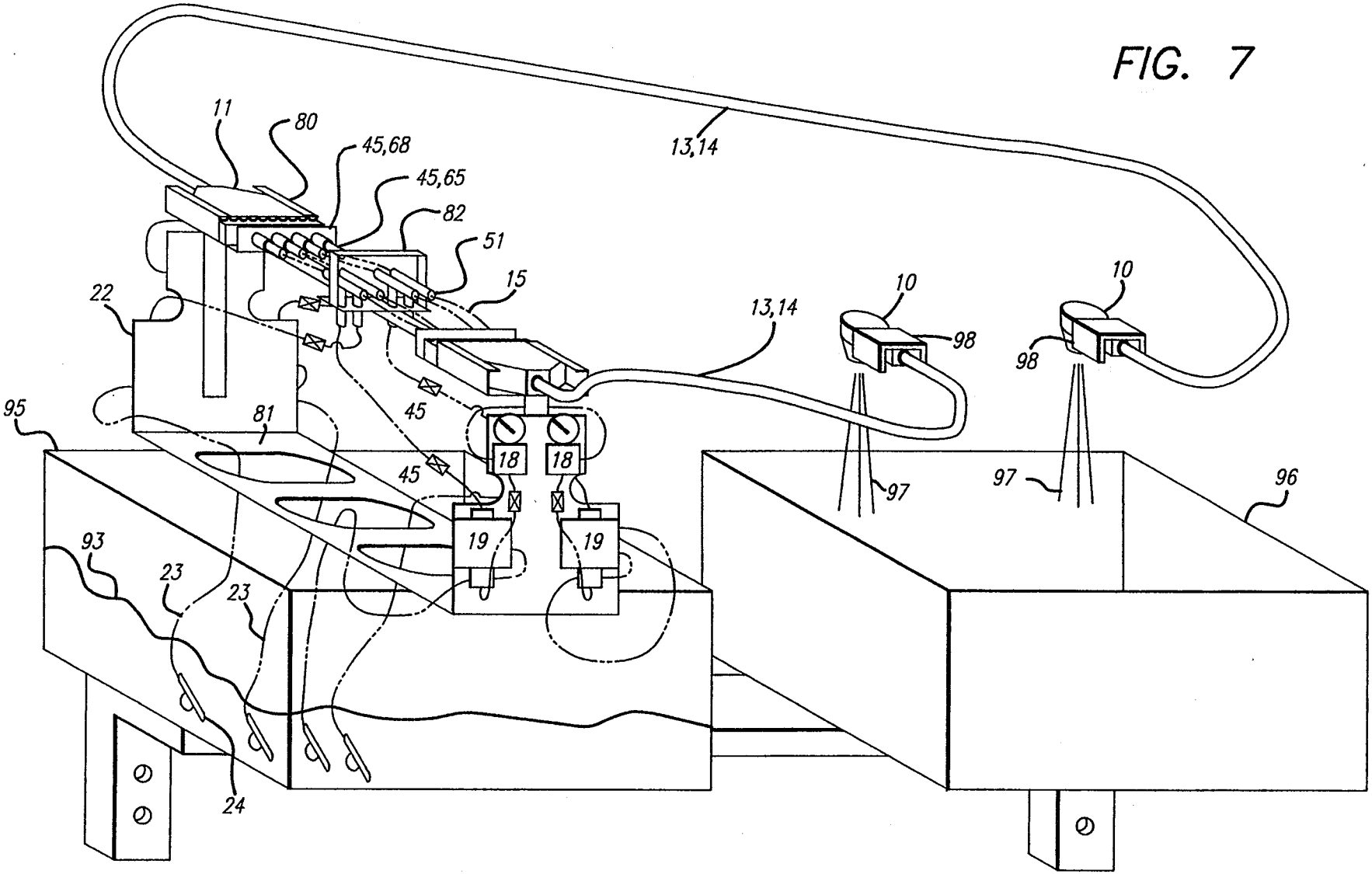
FIG. 7: Bi-Weekly cleaning configuration.

Bi-weekly sanitizing is performed on the entire system, see FIG. 7. The "Toolbox" chassis 22 has dimensions that fit holes 81 into an industrial sink, such as those found in fast food chains. Disconnect valve 24 at condiment bags 17, pickup up PRM module at handle 82 and place PRM Module with QDM 11 and Dispenser Head 10 attached on top of sink 95. Drop condiment supply line 23 with valve 24 into sink filled with condiment detergent fluid 93. If propellant gas line was disconnected to move PRM Module, it should now be reattached. Recycle detergent fluid 93 through system by pulling fluid from sink 95 and discharging it to sink 95 for 15 minutes by depressing button 43 on valve 40 on all valve buttons on dispenser head 10. To do this without having an operator present, slide Sanitizer Boot 98 over head 10 as shown in FIG. 7. When the Sanitizer Boot 98 is in place on head 10 all valve buttons are depressed. After detergent operation is complete, purge system with five gallons of sanitizer fluid discharging the spent sanitizer fluid 97 to a sink drain 96, as shown in FIG. 7, and replace PRM Module with Dispenser Heads attached to original work position. Reconnect condiment bags 17 at valves 24 and run condiment to the dispenser head by depressing button 43 on valve 40 on all valve/lines of condiment system.

We claim:

1. In a system for selectively dispensing condiments on demand from a plurality of collapsible condiment containers storing condiments at atmospheric pressure, the combination of:

a support for each of said condiment containers;

a gas driven metering pump for each of said condiment containers, each of said pumps having a drive gas inlet, a drive gas outlet, a condiment inlet, and a condiment outlet;

a plurality of dispenser heads, each dispenser head having a plurality of input passages, an outlet nozzle, and a valve for each of said input passages for controlling condiment flow from the input passage to said outlet nozzle; and for each of said pumps, first means for connecting a pump drive gas under pressure to said drive gas inlet, said drive gas outlet being vented, second means for connecting said collapsible condiment container to said condiment inlet, and third means for connecting said condiment outlet to one of said dispenser head input passages, said third means including a plurality of manifolds each having a single manifold inlet connected to one of said pump condiment outlets, a plurality of manifold outlets connected to one of each of said dispenser head input passages, and interengaging connectors for connecting each dispenser head to the manifold outlets and disconnecting the dispenser head from the manifold outlets;

whereby the connected pump is started by opening the corresponding dispenser head valve to draw condiment direct from said collapsible condiment container through said pump and said dispenser head valve to said outlet nozzle, collapsing said collapsible condiment container as the contents are withdrawn.

2. A system as defined in claim 1 wherein said first means includes a pressure regulator for adjustment of flow rate, and said second means includes a self sealing open/closed-connect/disconnect sanitary valve at said condiment container, said sanitary valve including two interengaging units each incorporating self-sealing means for sealing the unit when the two units are disengaged.

3. In a system for selectively dispensing condiments from a plurality of collapsible condiment containers storing condiments at atmospheric pressure in controlled portions, the combination of:

a support for each of said collapsible condiment containers;

a gas driven metering pump for each of said condiment containers, each of said pumps having a drive gas inlet, a drive gas outlet, a condiment inlet, and a condiment outlet;

a dispenser head having a plurality of input passages leading to an outlet nozzle, and a valve switch for each of said input passages; and for each of said pumps, first means for connecting a pump drive gas under pressure through a gas control valve to said drive gas inlet, with said drive gas outlet vented, second means for connecting said collapsible condiment container to said condiment inlet, and third means for connecting said condiment outlet to one of said dispenser head input passages, control means for said gas control valve for turning gas flow through the pump on and off for condiment portion control in response to actuation of said valve switch;

whereby the connected pump is started by actuating the corresponding dispenser head valve switch to draw condiment direct from said collapsible condiment container through said pump and said dispenser head input passage to said outlet nozzle, collapsing said collapsible condiment container as the contents are withdrawn;

said control means including portion control means for energizing said gas control valve a predetermined number of cycles in response to manual actuation of said valve switch.

4. A system as defined in claim 2 wherein each of said supports includes hanger means for supporting said condiment containers at an upper edge of each, with said sanitary valve at a bottom of each for vacuum evacuation and collapse of the container, and with said second means comprising a line without vents.

5. In a system for selectively dispensing condiments from a plurality of collapsible condiment containers storing condiments at atmospheric pressure, the combination of:

a support for each of said collapsible condiment containers;

a gas driven metering pump for each of said condiment containers, each of said pumps having a drive gas inlet, a drive gas outlet, a condiment inlet, and a condiment outlet;

a dispenser head having a plurality of input passages, an outlet nozzle, and a valve for each of said input passages for controlling condiment flow from the input passage to said outlet nozzle; and for each of said pumps, first means for connecting a pump drive gas under pressure to said drive gas inlet, with said drive gas outlet vented, second means for connecting said collapsible condiment container to said condiment inlet, and third means for connecting said condiment outlet to one of said dispenser head input passages, whereby the connected pump is started by opening the corresponding dispenser head valve to draw condiment from said collapsible condiment container through said pump to said outlet nozzle, collapsing said collapsible condiment container as the contents are withdrawn;

with said dispenser head including a push button for actuation of each valve, each of said valves being located in a respective input passage, each of said valves including:

means defining a valve passage in said dispenser head with a radial inlet opening connected to one of said inlet passages, a radial outlet opening connected to said outlet nozzle and a tapered valve seat between said inlet and outlet openings, with the taper converging toward said outlet opening;

a valve plunger axially slidable in said valve passage, with said push button at one end projecting out of said dispenser head;

a valve scat seal carried on said plunger for sealing engagement with said tapered valve seat; and a spring positioned in said valve passage for engaging said plunger and urging said valve seat seal toward said valve seat.

6. In a system for dispensing a condiment from a collapsible condiment container storing a condiment at atmospheric pressure, the combination of:

a support for said collapsible condiment container;

a gas driven metering pump for said condiment container, said pump having a drive gas inlet, a drive gas outlet, a condiment inlet, and a condiment outlet;

a dispenser head having an input passage, an outlet nozzle, and a valve for said input passage for controlling condiment flow from the input passage to said outlet nozzle; and said pump having first means for connecting a pump drive gas under pressure to said drive gas inlet, with said drive gas outlet vented, second means for connecting a collapsible condiment container to said condiment inlet, and third means for connecting said condiment outlet to said dispenser head input passage, whereby the connected pump is started by opening the dispenser head valve to draw condiment from said collapsible condiment container through said pump to said outlet nozzle, collapsing said collapsible condiment container as the contents are withdrawn;

with said dispenser head including a push button for actuation of said valve, said valve being located in said input passage, said valve including:

means defining a valve passage in said dispenser head with a radial inlet opening connected to said inlet passage, a radial outlet opening connected to said outlet nozzle and a tapered valve seat between said inlet and outlet openings, with the taper converging toward said outlet opening;

a valve plunger axially slidable in said valve passage, with said push button at one end projecting out of said dispenser head;

a valve seat seal carried on said plunger for sealing engagement with said tapered valve seat; and a spring positioned in said valve passage for engaging said plunger and urging said valve seat seal toward said valve seat.

* * * * *